US008203279B2

(12) United States Patent
Chen et al.

(10) Patent No.: US 8,203,279 B2
(45) Date of Patent: Jun. 19, 2012

(54) METHOD OF DIMMING

(75) Inventors: Chien-Yang Chen, Taipei (TW); Po-Kun Hsieh, Taoyuan County (TW); Tung-Hsin Lan, Taipei (TW); Ming-Chang Lin, Tainan County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 170 days.

(21) Appl. No.: 12/880,172

(22) Filed: Sep. 13, 2010

(65) Prior Publication Data

US 2012/0019155 A1 Jan. 26, 2012

(30) Foreign Application Priority Data

Jul. 22, 2010 (TW) ..... 99124149 A

(51) Int. Cl.
*H05B 41/16* (2006.01)

(52) U.S. Cl. ..... 315/247; 315/224; 315/185 S; 315/312; 315/291

(58) Field of Classification Search ..... 315/247, 315/224, 291, 307–312, 185 S
See application file for complete search history.

(56) References Cited

U.S. PATENT DOCUMENTS

| | | | | |
|---|---|---|---|---|
| 7,321,203 | B2 | 1/2008 | Marosek | |
| 7,999,487 | B2 * | 8/2011 | Szczeszynski | 315/291 |
| 2011/0084620 | A1 * | 4/2011 | Lee | 315/186 |
| 2011/0156605 | A1 * | 6/2011 | Ku et al. | 315/186 |
| 2012/0020134 | A1 * | 1/2012 | Lee et al. | 363/126 |
| 2012/0081017 | A1 * | 4/2012 | Darshan et al. | 315/193 |

FOREIGN PATENT DOCUMENTS

TW 200937998 9/2009

OTHER PUBLICATIONS

Chien-Yang Chen et al., Title: Driving Circuit for Driving Light Emitting Diodes and Dimmer, pending U.S. Appl. No. 12/880,161, filed Sep. 13, 2010.

* cited by examiner

*Primary Examiner* — Tuyet Thi Vo
(74) *Attorney, Agent, or Firm* — Winston Hsu; Scott Margo

(57) ABSTRACT

A power supply unit provides a voltage, and a driving current to a series of light emitting diodes. A dimming unit adjusts a duty cycle of an original dimming signal to generate a dimming signal according to the driving current and an ideal current. A current sink coupled to the series of light emitting diodes adjusts a duty cycle of the driving current according to the dimming signal.

2 Claims, 7 Drawing Sheets

METHOD OF DIMMING

BACKGROUND OF THE INVENTION

1. Field of the Invention

The present invention is related to a driving circuit for light emitting diodes, dimmer and method thereof, and particularly to a driving circuit for light emitting diodes, dimmer and method thereof by adjusting a duty cycle of driving current to dim accurately.

2. Description of the Prior Art

Generally speaking, dimming methods of light emitting diodes (LEDs) backlights have two modes, a burst mode and a continuous mode, where the continuous mode is used for adjusting a peak of a driving current of the light emitting diodes. But, operation in the continuous mode may influence optical characteristics of a display, so the burst mode is the main dimming method for light emitting diodes.

The burst mode dimming method controls turning-on or turning-off of driving current of light emitting diodes according to a pulse width modulation (PWM) dimming signal. Luminance of the LED is proportional to an average value of the driving current, which is adjusted linearly by adjusting a duty cycle of the PWM dimming signal. Due to original circuit conditions and design concerns regarding electromagnetic interference, when the driving current is turned on and turned off, the driving current for driving the light emitting diodes exhibits a delay time and a rising time before stabilizing. Please refer to FIG. 1. FIG. 1 is a diagram illustrating a practical average value of the driving current not being equal to an average value of an ideal current due to the delay time and the rising time of the driving current. As shown in FIG. 1, because the practical average value of the driving current is not equal to the average value of the ideal current, a relationship between the practical average value of the driving current and the duty cycle of the PWM dimming signal is nonlinear. Therefore, the prior art can not control accurately luminance of the light emitting diodes and has poorer display quality.

SUMMARY OF THE INVENTION

An embodiment provides a driving circuit for light emitting diodes. The driving circuit for light emitting diodes includes a power supply unit, a series of light emitting diodes, a current sink, and a dimming unit. The power supply unit has an input terminal for receiving an alternating current (AC) voltage/a first direct current (DC) voltage, and an output terminal for supplying a second DC voltage and a driving current. The series of light emitting diodes includes at least one light emitting diode, wherein the series of light emitting diodes has a first terminal coupled to the output terminal of the power supply unit for receiving the second DC voltage and the driving current, and a second terminal. The current sink is coupled to the second terminal of the series of light emitting diodes, wherein the current sink has a dimming control terminal for receiving a dimming signal. And the dimming unit is used for adjusting a duty cycle of an original dimming signal to generate the dimming signal according to the driving current and an ideal current, wherein the dimming unit has a first input terminal coupled to the second terminal of the series of light emitting diodes for sensing the driving current, a second input terminal for receiving the original dimming signal, a third input terminal coupled to the current sink for sensing the ideal current, and an output terminal for outputting the dimming signal.

Another embodiment provides a driving circuit for light emitting diodes. The driving circuit for light emitting diodes includes a power supply unit, a plurality of series of light emitting diodes, a current sink, and a dimming unit. The power supply unit has an input terminal for receiving an alternating current (AC) voltage/a first direct current (DC) voltage, and an output terminal for supplying a second DC voltage and a driving current. The plurality of series of light emitting diodes, each series of light emitting diodes includes at least one light emitting diode, wherein each series of light emitting diodes has a first terminal coupled to the output terminal of the power supply unit for receiving the second DC voltage and the driving current, and a second terminal. The current sink is coupled to the second terminals of the plurality of series of light emitting diodes, wherein the current sink has a dimming control terminal for receiving a dimming signal. And the dimming unit is used for adjusting a duty cycle of an original dimming signal to generate the dimming signal according to the driving current and an ideal current, wherein the dimming unit has a first input terminal coupled to the second terminal of the series of light emitting diodes for sensing the driving current, a second input terminal for receiving the original dimming signal, a third input terminal coupled to the current sink for sensing the ideal current, and an output terminal for outputting the dimming signal.

Another embodiment provides a dimmer. The dimmer includes a first sensing circuit, a second sensing circuit, an adder, a dimming compensator, and a PWM dimming signal generator. The first sensing circuit is used for generating a practical average voltage according to a driving current. The second sensing circuit is used for generating an ideal average voltage according to an ideal current and an original dimming signal. The adder is coupled to the first sensing circuit and the second sensing circuit for generating a difference between the ideal average voltage and the practical average voltage. The dimming compensator is coupled to the adder for generating a direct current (DC) compensation value according to the difference. The pulse width modulation (PWM) dimming signal generator is coupled to the dimming compensator and the current sink for generating a dimming signal according to the DC compensation value.

Another embodiment provides a method of dimming. The method includes generating a practical average voltage according to a driving current; generating an ideal average voltage according to an ideal current and an original dimming signal; generating a difference between the ideal average voltage and the practical average voltage; generating a DC compensation value according to the difference; generating a dimming signal according to the DC compensation value; and adjusting a duty cycle of the driving current according to the dimming signal; wherein the driving current is used for driving a series of light emitting diodes.

A driving circuit for light emitting diodes, dimmer and method thereof provided by the present invention adjust the duty cycle of the original dimming signal to generate the dimming signal according to the driving current of the series of light emitting diodes and the ideal current. Then, the switch of the current sink can adjust the duty cycle of the driving current according to the dimming signal. Therefore, the driving circuit for light emitting diodes, dimmer and method thereof provided by the present invention can control accurately luminance of at least one series of light emitting diodes by adjusting the duty cycle of the driving current to improve a display quality.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
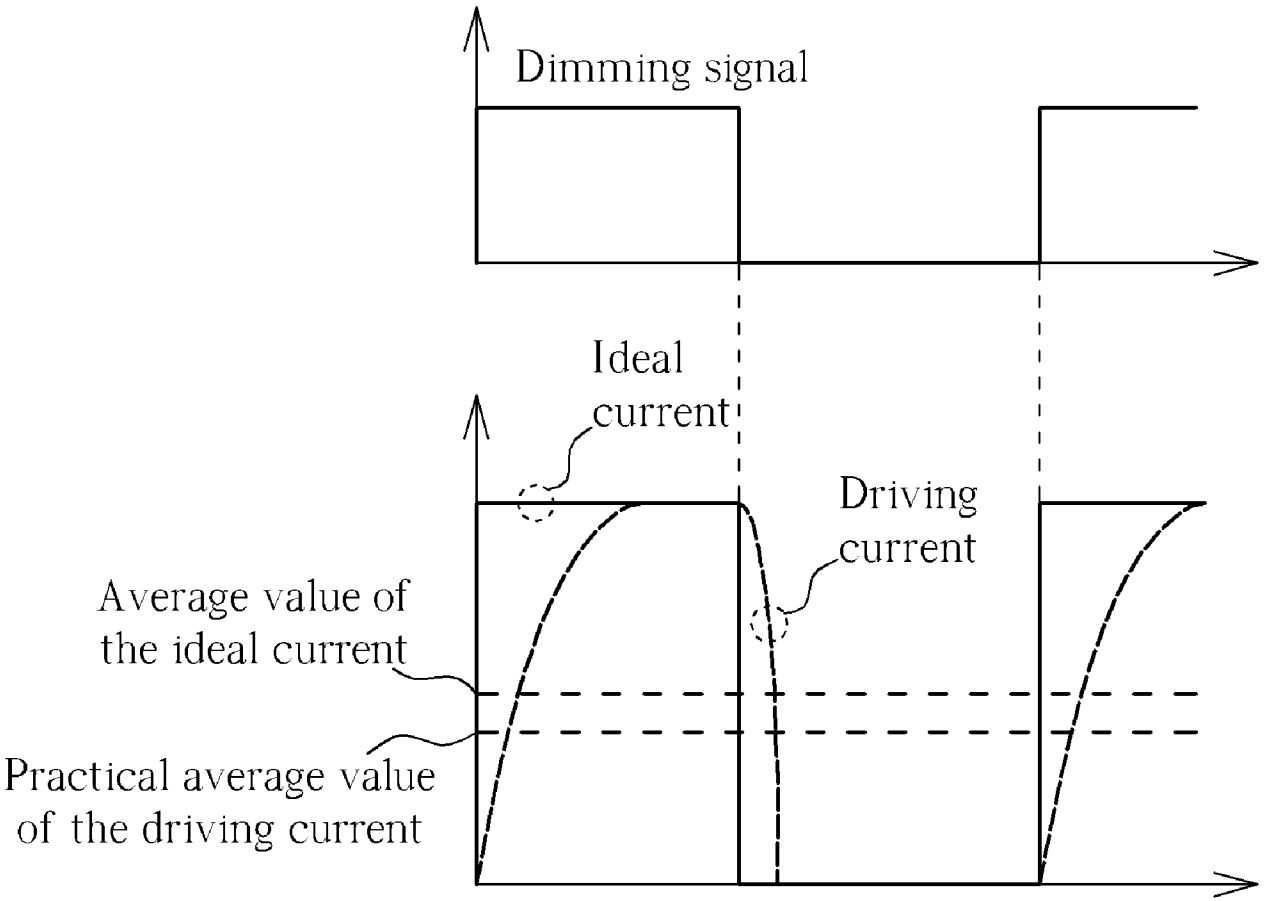
FIG. 1 PRIOR ART
FIG. 1 is a diagram illustrating a practical average value of the driving current not being equal to an average value of an ideal current due to the delay time and the rising time of the driving current.
Figure 2:
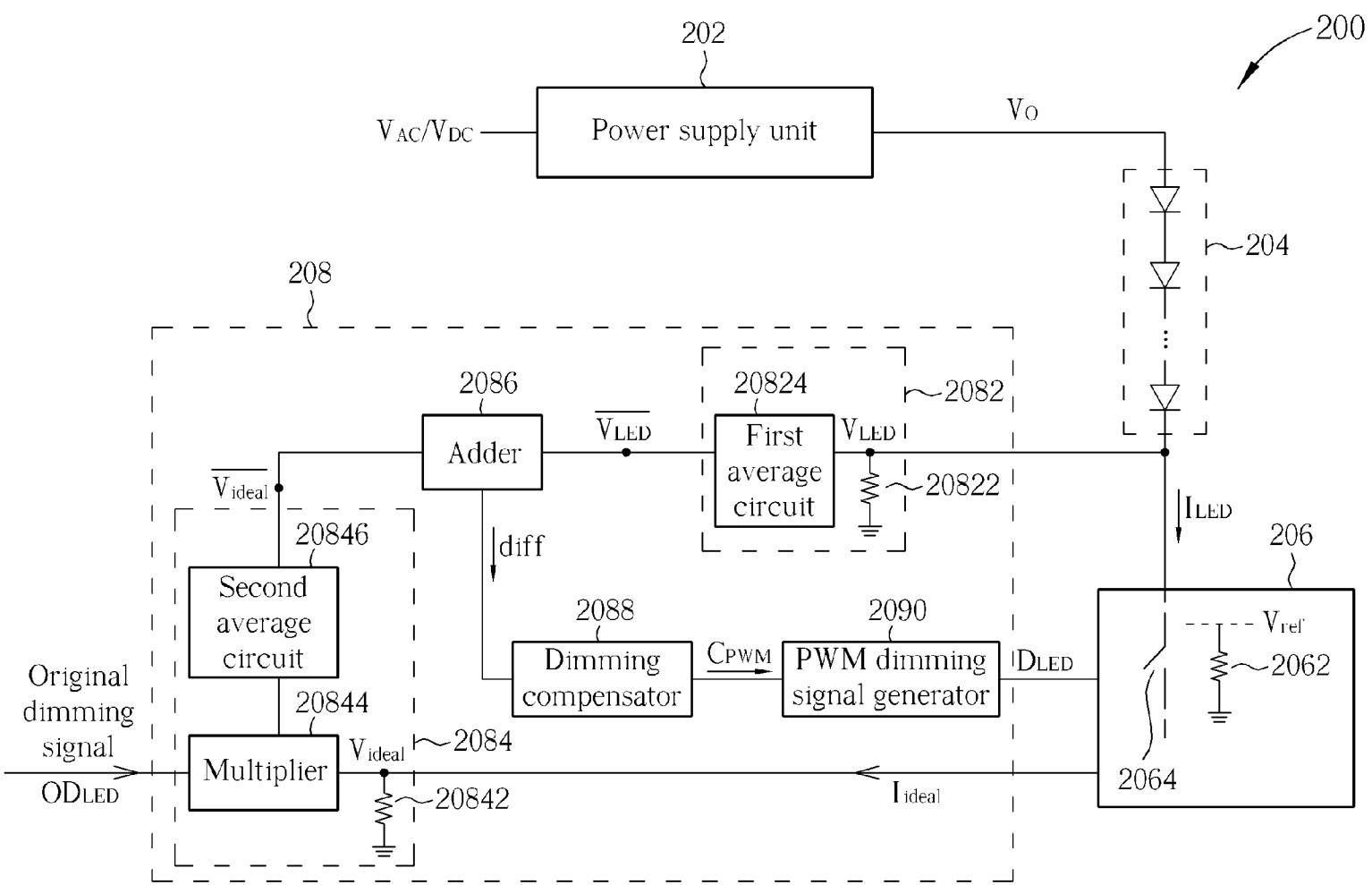
FIG. 2 is a diagram illustrating a driving circuit for light emitting diodes capable of accurate dimming according to an embodiment of the present invention.

Please refer to FIG. 2. FIG. 2 is a diagram illustrating a driving circuit 200 for light emitting diodes capable of accurate dimming according to an embodiment of the present invention. The driving circuit 200 includes a power supply unit 202, a series of light emitting diodes 204, a current sink 206 and a dimming unit 208. The power supply unit 202 has an input terminal for receiving an AC voltage $V_{AC}$ or a DC voltage $V_{DC}$, and an output terminal for providing a driving voltage Vo and a driving current $I_{LED}$. The series of light emitting diodes 204 includes at least one light emitting diode, and the series of light emitting diodes 204 has a first terminal coupled to the output terminal of the power supply unit 202 for receiving the DC voltage $V_o$ and the driving current $I_{LED}$. The current sink 206 is coupled to a second terminal of the series of light emitting diodes 204, and the current sink 206 has a dimming control terminal for receiving a dimming signal $D_{LED}$. In addition, the current sink 206 includes a reference voltage $V_{ref}$ and a set resistor 2062, so the current sink 206 can generate an ideal current $I_{ideal}$ according to the reference voltage $V_{ref}$ and the set resistor 2062. The dimming unit 208 is used for adjusting a duty cycle of an original dimming signal $OD_{LED}$ to generate the dimming signal $D_{LED}$ according to the driving current $I_{LED}$ and an ideal current $I_{ideal}$. The dimming unit 208 has a first input terminal coupled to the second terminal of the series of light emitting diodes 204 for sensing the driving current $I_{LED}$, a second input terminal for receiving the original dimming signal $OD_{LED}$, a third input terminal coupled to the current sink 206 for sensing the ideal current $I_{ideal}$, and an output terminal for outputting the dimming signal $D_{LED}$, where both the dimming signal $D_{LED}$ and the original dimming signal $OD_{LED}$ are pulse width modulation signals, and the driving current $I_{LED}$ is a pulse width modulation current.

The dimming unit 208 includes a first sensing circuit 2082, a second sensing circuit 2084, an adder 2086, a dimming compensator 2088, and a PWM dimming signal generator 2090. The first sensing circuit 2082 includes a first resistor 20822 and a first average circuit 20824, where the first average circuit 20824 is coupled to the first resistor 20822. After the first sensing circuit 2082 senses the driving current $I_{LED}$ through the first input terminal of the dimming unit 208, the first resistor 20822 generates a practical voltage $V_{LED}$ (pulse width modulation voltage) according to the driving current $I_{LED}$, and the first average circuit 20824 generates a practical average voltage $\overline{V_{LED}}$ according to the practical voltage $V_{LED}$. The second sensing circuit 2084 includes a second resistor 20842, a multiplier 20844, and a second average circuit 20846, where the multiplier 20844 is coupled to the second resistor 20842, and the second average circuit 20846 is coupled to the multiplier 20844. After the second sensing circuit 2084 senses the ideal current $I_{ideal}$ through the third input terminal of the dimming unit 208, the second resistor 20842 generates an ideal voltage $V_{ideal}$ according to the ideal current $I_{ideal}$. The multiplier 20844 receives the original dimming signal $OD_{LED}$ from the second input terminal of the dimming unit 208, and modulates the original dimming signal $OD_{LED}$ to generate an ideal dimming signal according to the ideal voltage $V_{ideal}$. The second average circuit 20846 is coupled to the multiplier 20844 for generating an ideal average voltage $\overline{V_{ideal}}$ according to the ideal dimming signal.

The adder 2086 is coupled to the first sensing circuit 2082 and the second sensing circuit 2084 for generating a difference diff between the ideal average voltage $\overline{V_{ideal}}$ and the practical average voltage $\overline{V_{LED}}$. The dimming compensator 2088 is coupled to the adder 2086 for generating a DC compensation value $C_{PWM}$ according to the difference diff. The PWM dimming signal generator 2090 is coupled to the dimming compensator 2088 and the current sink 206 for generating the dimming signal $D_{LED}$ according to the DC compensation value $C_{PWM}$. The dimming control terminal of the current sink 206 is coupled to the output terminal of the dimming unit 208 for receiving the dimming signal $D_{LED}$, and the current sink 206 further includes a switch 2064 for adjusting a duty cycle of the driving current $I_{LED}$ according to the dimming signal $D_{LED}$.

Figure 3B:
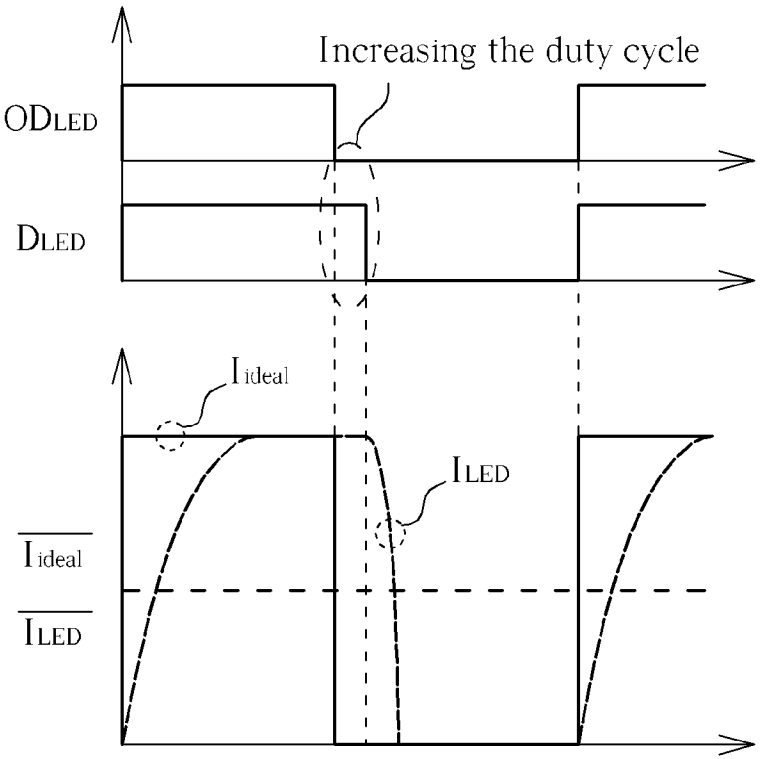
FIG. 3B is a diagram illustrating the duty cycle of the driving current after being adjusted and the duty cycle of the ideal current.
Figure 3A:
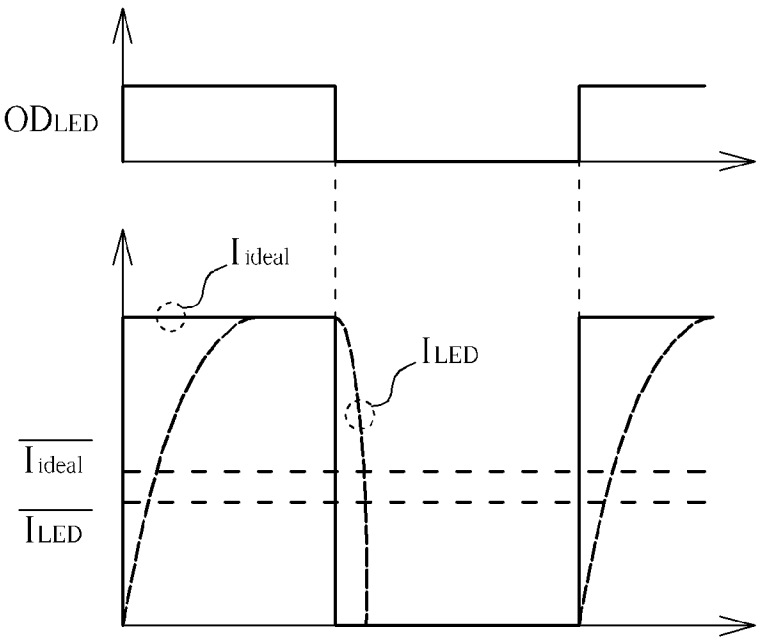
FIG. 3A is a diagram illustrating the duty cycle of the driving current before being adjusted and a duty cycle of the ideal current.

Please refer to FIG. 3A and FIG. 3B. FIG. 3A is a diagram illustrating the duty cycle of the driving current $I_{LED}$ before being adjusted and a duty cycle of the ideal current $I_{ideal}$, and FIG. 3B is a diagram illustrating the duty cycle of the driving current $I_{LED}$ after being adjusted and the duty cycle of the ideal current $I_{ideal}$. As shown in FIG. 3A, when the current sink 206 has not adjusted the duty cycle of the driving current $I_{LED}$ yet according to the dimming signal $D_{LED}$, the driving current ILED has non-ideality (rising time and falling time), so that an ideal average current $\overline{I_{ideal}}$ is different from a driving average current $\overline{I_{LED}}$. As shown in FIG. 3B, the current sink 206 adjusts the duty cycle of the driving current $I_{LED}$ according to the dimming signal $D_{LED}$, so the ideal average current $\overline{I_{ideal}}$ is the same as the driving average current $\overline{I_{LED}}$.

Figure 4B:
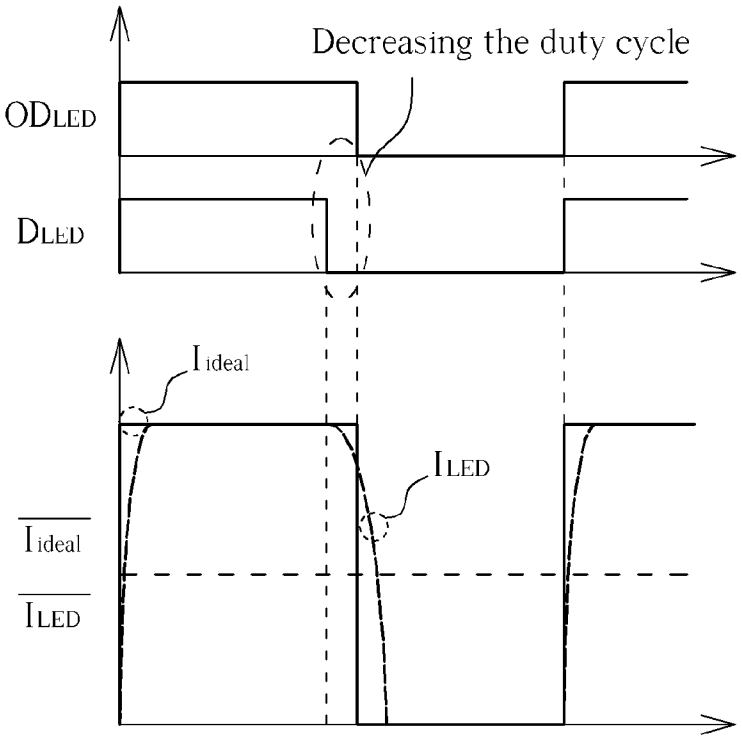
FIG. 4A and FIG. 4B are diagrams illustrating decreasing the duty cycle of the driving current when the driving average current before being adjusted is larger than the ideal average current.
Figure 4A:
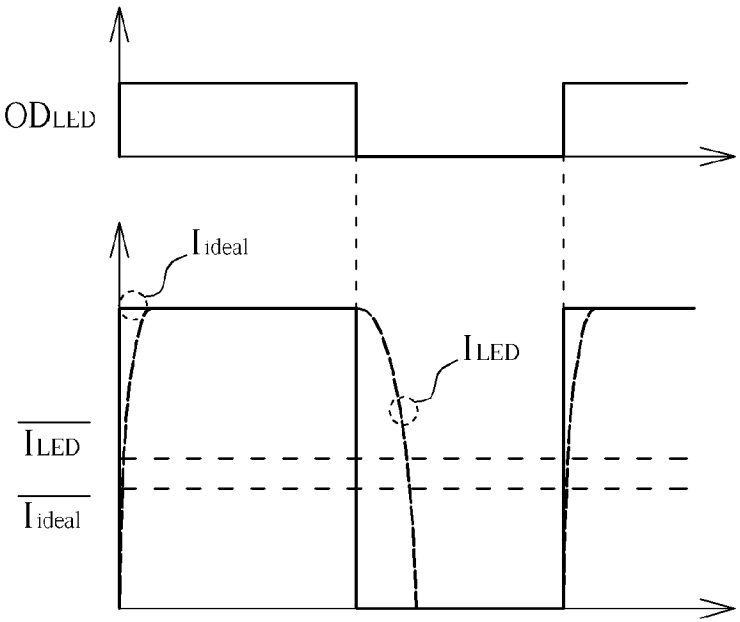

In FIG. 3A and FIG. 3B, the driving average current $\overline{I_{LED}}$ before being adjusted is lower than the ideal average current $\overline{I_{ideal}}$ so as to increase the duty cycle of the driving current $I_{LED}$. Please refer to FIG. 4A and FIG. 4B. FIG. 4A and FIG. 4B are diagrams illustrating decreasing the duty cycle of the driving current $I_{LED}$ when the driving average current $\overline{I_{LED}}$ before being adjusted is larger than the ideal average current $\overline{I_{ideal}}$. The driving average current $\overline{I_{LED}}$ can be the same as the ideal average current $\overline{I_{ideal}}$ by increasing or decreasing the duty cycle of the driving current $I_{LED}$ to achieve a high linearity accurate dimming.

Figure 5:
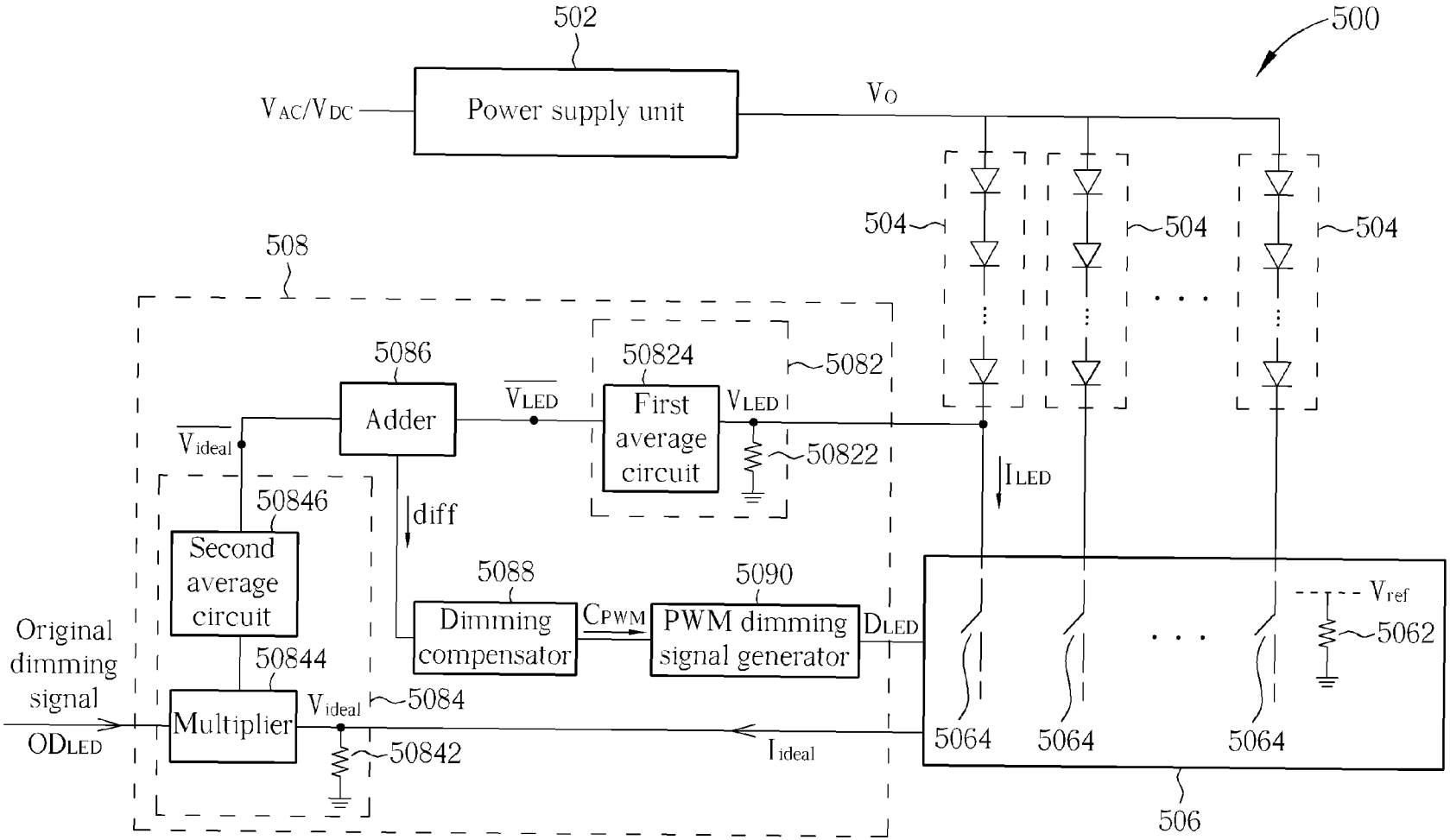
FIG. 5 is a diagram illustrating a driving circuit for light emitting diode capable of accurate dimming according to another embodiment of the present invention.

Please refer to FIG. 5. FIG. 5 is a diagram illustrating a driving circuit 500 for light emitting diodes 500 capable of accurate dimming according to another embodiment of the present invention. The driving circuit 500 includes a power supply unit 502, a plurality of series of light emitting diodes 504, a current sink 506, and a dimming unit 508. The current sink 506 includes a reference voltage $V_{ref}$, a set resistor 5062, and a plurality of switches 5064. The dimming unit 508 includes a first sensing circuit 5082, a second sensing circuit 5084, an adder 5086, a dimming compensator 5088, and a PWM dimming signal generator 5090. The first sensing circuit 5082 includes a first resistor 50822 and a first average circuit 50824. The second sensing circuit 5084 includes a second resistor 50842, a multiplier 50844, and a second average circuit 50846. A difference between the driving circuit 500 and the driving circuit 200 is that the driving circuit 500 has the plurality of series of light emitting diodes 504, and each series of light emitting diodes 504 corresponds to a switch 5064. Because materials and sizes of the plurality of series of light emitting diodes 504 are the same, rising time and falling time of each series of light emitting diodes 504 are roughly the same. Therefore, a first input terminal of the dimming unit 508 is only coupled to a second terminal of a series of light emitting diodes 504 for sensing a driving current $I_{LED}$ but a dimming signal $D_{LED}$ is transmitted to each switch 5064 of the current sink 506. The plurality of switches 5064 adjust a duty cycle of each series of light emitting diodes 504 according to the dimming signal $D_{LED}$. Subsequent operational principles of the driving circuit 500 are the same as the driving circuit 200, so further description thereof is omitted for simplicity.

Figure 6:
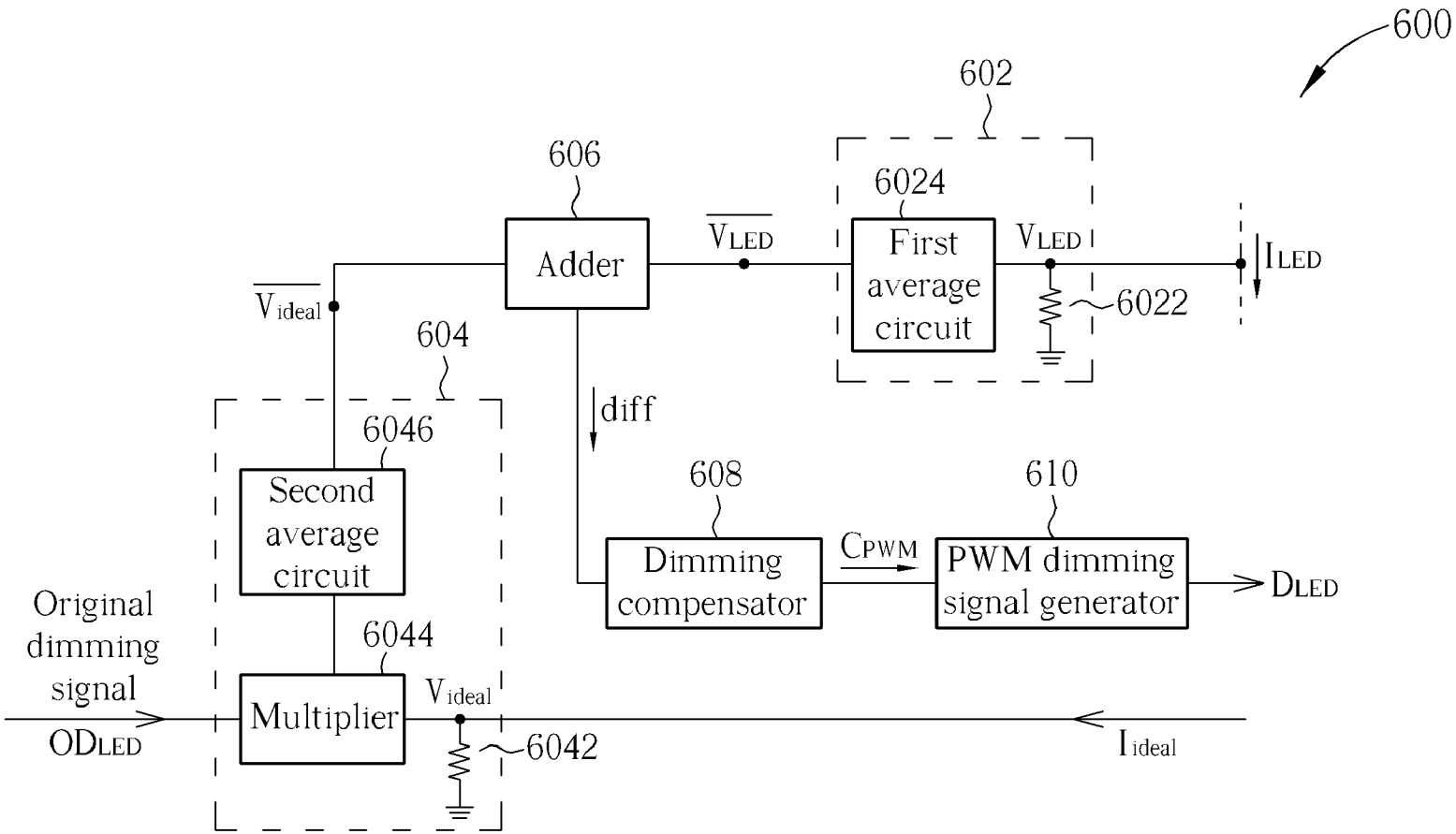
FIG. 6 is a diagram illustrating a dimmer capable of accurate dimming according to another embodiment of the present invention.

Please refer to FIG. 6. FIG. 6 is a diagram illustrating a dimmer 600 capable of accurate dimming according to another embodiment of the present invention. The dimmer 600 includes a first sensing circuit 602, a second sensing circuit 604, an adder 606, a dimming compensator 608, and a PWM dimming signal generator 610. The first sensing circuit 602 includes a first resistor 6022 and a first average circuit 6024. The second sensing circuit 604 includes a second resistor 6042, a multiplier 6044, and a second average circuit 6046. Subsequent operational principles of the dimmer 600 are the same as the dimming unit 208, 508, so further description thereof is omitted for simplicity.

Figure 7:
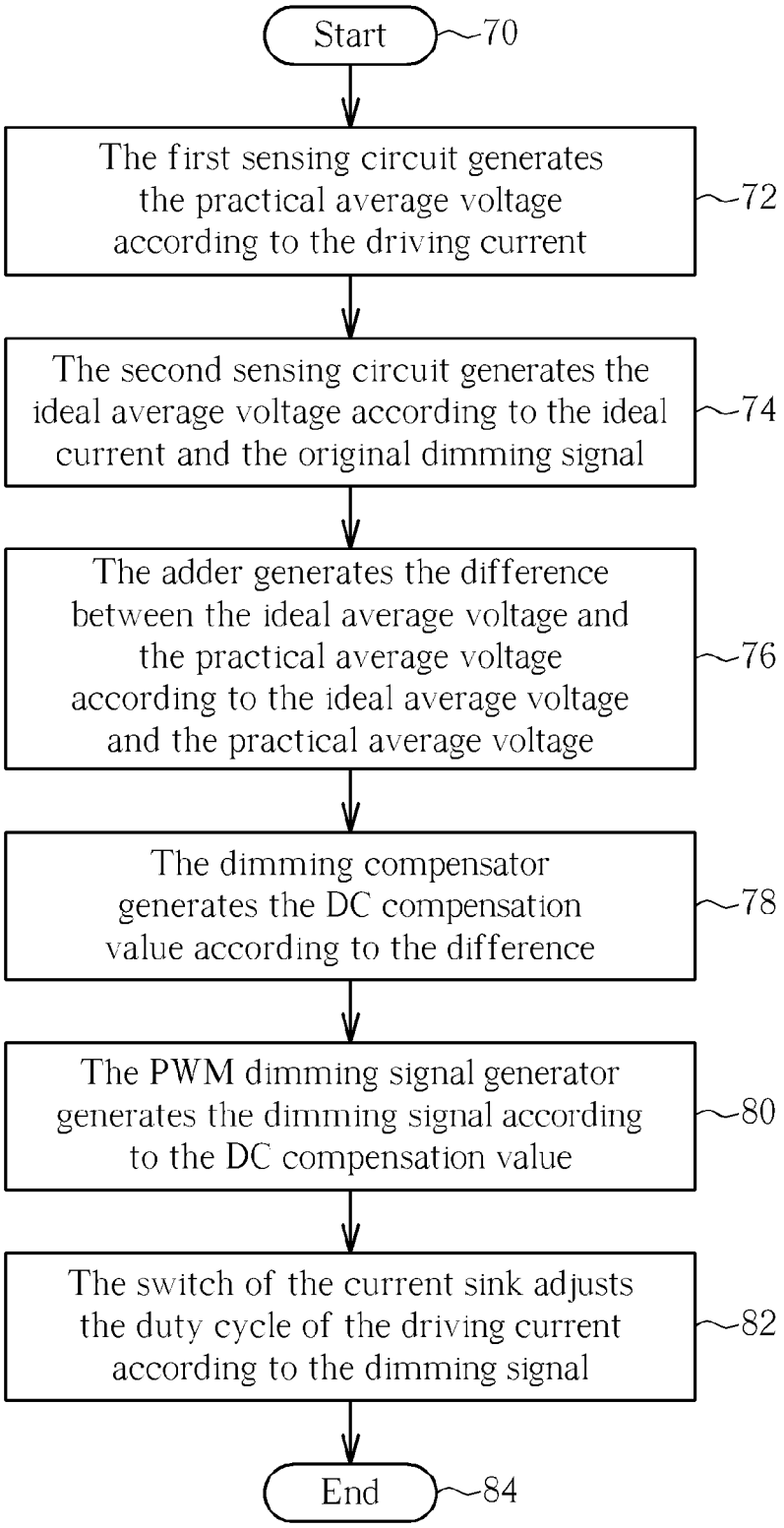
FIG. 7 is a flowchart illustrating a method of accurate dimming according to another embodiment of the present invention.

Please refer to FIG. 7. FIG. 7 is a flowchart illustrating a method of performing accurate dimming according to another embodiment of the present invention. FIG. 7 uses the driving circuit 200 in FIG. 2 to illustrate the method. Detailed steps are as follows:

Step 70: Start.

Step 72: The first sensing circuit 2082 generates the practical average voltage $\overline{V_{LED}}$ according to the driving current $I_{LED}$.

Step 74: The second sensing circuit 2084 generates the ideal average voltage $\overline{V_{ideal}}$ according to the ideal current $I_{ideal}$ and the original dimming signal $OD_{LED}$.

Step 76: The adder 2086 generates the difference diff between the ideal average voltage $\overline{V_{ideal}}$ and the practical average voltage $\overline{V_{LED}}$ according to the ideal average voltage $\overline{V_{ideal}}$ and the practical average voltage $\overline{V_{LED}}$.

Step 78: The dimming compensator 2088 generates the DC compensation value $C_{PWM}$ according to the difference diff.

Step 80: The PWM dimming signal generator 2090 generates the dimming signal $D_{LED}$ according to the DC compensation value $C_{PWM}$.

Step 82: The switch 2064 of the current sink 206 adjusts the duty cycle of the driving current $I_{LED}$ according to the dimming signal $D_{LED}$.

Step 84: End.

In Step 72, the driving current $I_{LED}$ is used for driving the series of light emitting diodes 204. In Step 72, the first resistor 20822 generates the practical voltage $V_{LED}$ (pulse width modulation voltage) according to the driving current $I_{LED}$, and the first average circuit 20824 generates the practical average voltage $\overline{V_{LED}}$ according to the practical voltage $V_{LED}$. In Step 74, the second resistor 20842 generates the ideal voltage $V_{ideal}$ according to the ideal current $I_{ideal}$, the multiplier 20844 receives the original dimming signal $OD_{LED}$ through the second input terminal of the dimming unit 208 and modulates the original dimming signal $OD_{LED}$ to generate an ideal dimming signal according to the ideal voltage $V_{ideal}$ and the second average circuit 20846 generates the ideal average voltage $\overline{V_{ideal}}$ according to the ideal dimming signal.

To sum up, the driving circuit for light emitting diodes, dimmer and method thereof described above adjust the duty cycle of the original dimming signal to generate the dimming signal according to the driving current of the light emitting diodes and the ideal current. Then, the switch of the current sink can adjust the duty cycle of the driving current according to the dimming signal. Therefore, the driving circuit for light emitting diodes, dimmer and method thereof described above can accurately control luminance of the light emitting diodes by adjusting the duty cycle of the driving current to improve on the disadvantages of not controlling luminance of the light emitting diodes accurately and poorer display quality in the prior art.

Those skilled in the art will readily observe that numerous modifications and alterations of the device and method may be made while retaining the teachings of the invention.

What is claimed is:

1. A method of dimming, comprising:

generating a practical average voltage according to a driving current;

generating an ideal average voltage according to an ideal current and an original dimming signal;

generating a difference between the ideal average voltage and the practical average voltage;

generating a DC compensation value according to the difference;

generating a dimming signal according to the DC compensation value; and adjusting a duty cycle of the driving current according to the dimming signal;

wherein the driving current is used for driving a series of light emitting diodes.

2. The method of claim 1, further comprising:

generating a practical voltage according to the driving current;

generating the practical average voltage according to the practical voltage;

generating an ideal voltage according to the ideal current;

modulating the original dimming signal to generate an ideal dimming signal according to the ideal voltage; and generating the ideal average voltage according to the ideal dimming signal.

* * * * *